US006831535B1

(12) United States Patent
Wen et al.

(10) Patent No.: US 6,831,535 B1
(45) Date of Patent: Dec. 14, 2004

(54) BISTABLE ELECTROMAGNETIC RELAY

(75) Inventors: Weijia Wen, Kowloon (HK); Ping Sheng, Kowloon (HK); Chau Kwan Nam, Kowloon (HK)

(73) Assignee: China Patent Investment Limited, Hong Kong (CN)

( * ) Notice: Subject to any disclaimer, the term of this patent is extended or adjusted under 35 U.S.C. 154(b) by 0 days.

(21) Appl. No.: 10/720,185

(22) Filed: Nov. 25, 2003

(51) Int. Cl.[7] ..... H01H 9/00

(52) U.S. Cl. ..... 335/132; 335/179; 335/183; 335/234

(58) Field of Search ..... 335/132, 177, 335/179, 180, 182, 183, 229–234

(56) References Cited

U.S. PATENT DOCUMENTS

| | | | | |
|---|---|---|---|---|
| 4,271,450 | A | 6/1981 | Nishimura et al. | |
| 4,617,546 | A | * 10/1986 | Kellogg et al. | 335/170 |
| 4,703,293 | A | 10/1987 | Ono et al. | |
| 4,774,623 | A | 9/1988 | Gilman | |
| 4,975,666 | A | 12/1990 | Nobutoki | |
| 5,867,081 | A | 2/1999 | Arnoux et al. | |
| 6,424,243 | B1 | * 7/2002 | Forster | 335/132 |
| 6,538,541 | B1 | * 3/2003 | Kralik | 335/177 |

* cited by examiner

*Primary Examiner*—Ramon M. Barrera
(74) *Attorney, Agent, or Firm*—Burns, Doane, Swecker & Mathis, L.L.P.

(57) ABSTRACT

There is disclosed an electromagnetic relay comprising a stationary first member and a second member adapted to move towards and away from the first member such that when the second member move towards the first member an electrical contact is closed. Spring means biases the members apart, and permanent magnet means are provided for generating a force of attraction between the members, and selectively operable means is provided for generating an electromagnetic force. The permanent magnet means has a strength such that when the first and second members are apart the permanent magnet means is insufficient to overcome the spring means, but when the members are brought together the permanent magnet means is able to hold the members together against the spring means. The means for generating an electromagnetic force can be operated in a first condition to provide an attractive force between said members sufficient with the permanent magnet means to overcome the spring means and to bring the members together, and in a second condition to provide a repulsive force between members sufficient with the spring means to overcome the permanent magnet means and move the members apart.

12 Claims, 2 Drawing Sheets

BISTABLE ELECTROMAGNETIC RELAY

FIELD OF THE INVENTION

This invention relates to a bistable electromagnetic relay, and in particular to a novel bistable electromagnetic relay requiring low power consumption and in particular embodiments providing means for ensuring the connection in the event of accidental opening of the relay.

BACKGROUND OF THE INTENTION

Electrical relays are devices that enable a connection to be made between two electrodes in order to transmit a current. Conventional electrical relays are based on the electromagnetic effects. In a conventional relay the ON (ie closed) state is obtained by applying a current to an electromagnet so that an electromagnetic attraction exists between the poles of two magnets and this attraction acts to bring electrodes into contact to make an electrical connection. Conventionally this ON state is maintained until the current to the electromagnet is removed, the magnetic poles then lose their attractive power and are moved away from each other by a biasing spring that normally urges them apart thus opening the contact between the electrodes. Such conventional relays have been very well-known for many years and are very effective. However, they do suffer from the drawback that generally the current must be continually supplied to the electromagnet in order to maintain the ON condition and this does result in relatively high power consumption. In order to overcome this problem a number of designs for bistable relays have been proposed

PRIOR ART

U.S. Pat. No. 4,703,293 and U.S. Pat. No. 4,975,666 are illustrative of examples of what are known as "polarized relays" and U.S. Pat. No. 5,867,081 is an example of a "bistable relay" that use a permanent magnet that maintains the attractive force even when the current to the electromagnet is switched off. However, in these designs because the ON state is maintained by the permanent magnet, it is difficult to achieve a reliable switch from the ON (closed) to OFF (open) state when that is desired. Furthermore, if the relay is being maintained in the ON state solely by the permanent magnet, then if the relay accidentally receives a mechanical blow that can open the connection it is not clear how the ON state can be re-established. This latter problem, the ability of the ON state to be re-established after accidental opening, is in practical designs an important consideration.

U.S. Pat. No. 4,271,450 and U.S. Pat. No. 4,774,623 are examples of relays that use a bistable electronic control circuit, but these designs are difficult to implement in practical relay designs.

For the above reasons while bistable relays have a number of theoretical advantages, they have nor to date achieved widespread practical applications.

SUMMARY OF THE INVENTION

According to the invention there is provided an electromagnetic relay comprising, a stationary first member and a second member adapted to move towards and away from the first member such that when the second member moves towards the first member an electrical contact is closed, spring means for normally biasing said members apart, permanent magnet means for generating a force of attraction between said members, and selectively operable means for generating an electromagnetic force, wherein the permanent magnet means has a strength such that when the first and second members are apart the permanent magnet means is insufficient to overcome the spring means and wherein when the said members are brought together the permanent magnet means is able to hold the members together against the spring means, and wherein said means for generating an electromagnetic force can be operated in a first condition to provide an attractive force between said members sufficient with said permanent magnet means to overcome said spring means and to bring said members together, and in a second condition to provide a repulsive force between members sufficient with said spring means to overcome said permanent magnet means and move said members apart.

Preferably switch means are provided whereby the means for generating an electromagnetic force is switched off when the members are brought together. The switch means may be adapted to turn on the means for generating an electromagnetic force in the event of an accidental displacement of the first and second members.

The permanent magnet means is preferably provided on said movable second member, while the means for generating an electromagnetic force is provided on the fixed first member.

The first and second members may comprise a pair of U-shaped magnetic yokes, the arms of said yokes facing each other, with the permanent magnet means preferably being provided at the ends of the arms of one said yoke, and preferably the means for generating an electromagnetic force comprises a coil wound around one said yoke and means for supplying current to the coil. Means may be provided for selectively supplying current in opposite directions to the coil to generate the attractive and repulsive forces.

An electronic control circuit may be provided for supplying the current to the coil. This control circuit may include switch means for turning the relay on and off, and when the relay is turned on the circuit provides a current to the coil in a first direction to generate the attractive electromagnetic force and at the same time a capacitor is charged, and when said the is turned off the capacitor discharges to supply a current to the coil in the opposite direction to generate the repulsive electromagnetic force.

BRIEF DESCRIPTION OF THE DRAWINGS

An embodiment of the present invention will now be described by way of example and with reference to the accompanying drawings, in which.

DETAILED DESCRIPTION OF PREFERRED EMBODIMENTS

Figure 1:
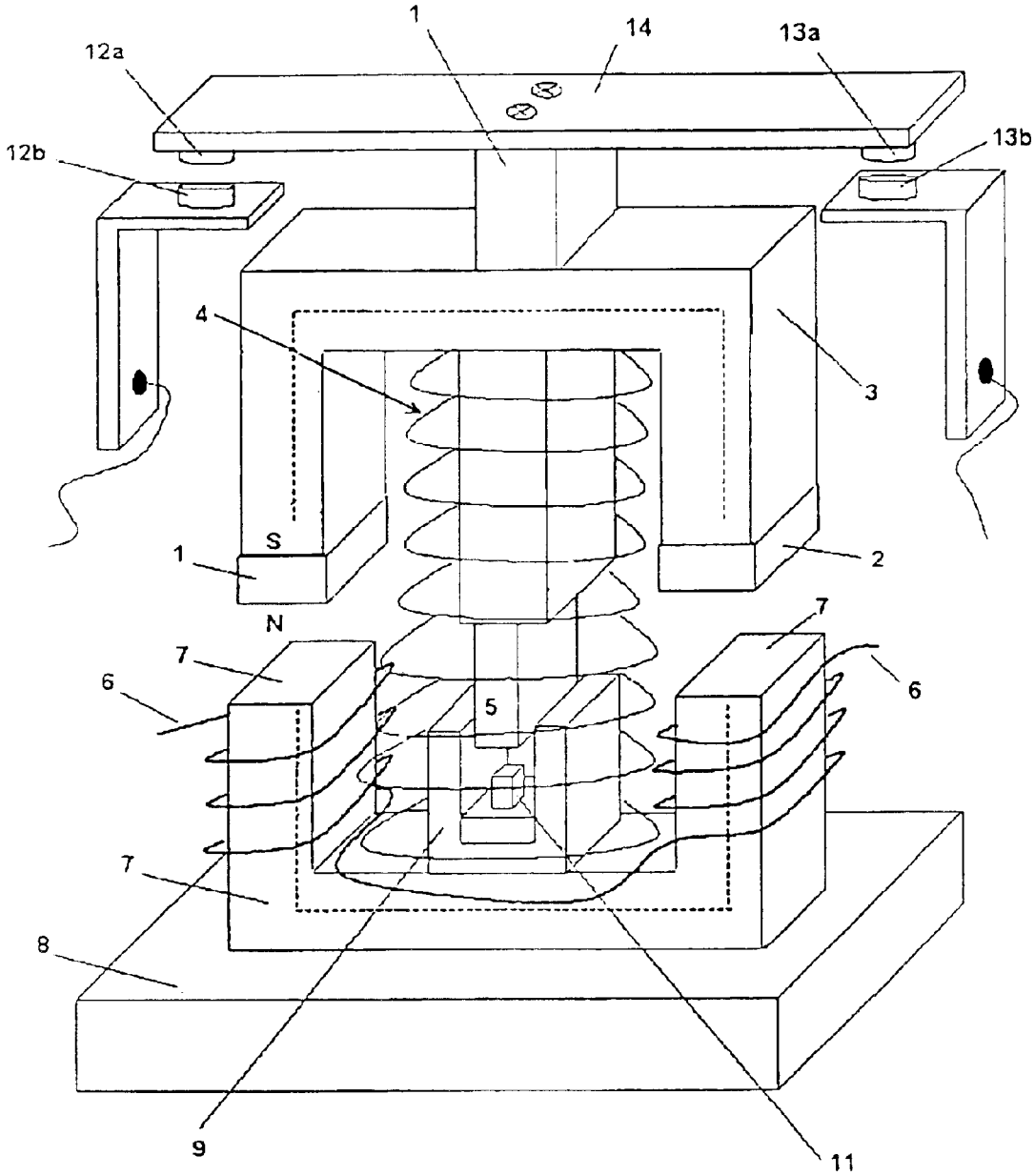
FIG. 1 is a perspective view of a relay according to an embodiment of the present invention.

FIG. 1 shows a bistable relay according to an embodiment of the invention. The relay comprises two flux-conductive U-shaped yokes 3,7 arranged so that the ends of the U-shaped yokes 3,7 face each other. In this embodiment the upper yoke 3 is movable, while the lower yoke 7 is stationary and fixed on a base 8. It will be understood that the terms "upper" and "lower" are simply used for convenience when referring to the figure and should not be interpreted as limiting. The two ends of the U-shaped movable yoke 3 are provided with permanent magnets 1,2, while a coil 6 is wound around the arms of the stationary lower yoke 7. A spring 4 is provided between the yokes 3,7 that acts to normally bias the two yokes 3,7 apart from each other.

Between the two arms of the stationary lower yoke 7 there is provided a holder 9 in the form of a U-shaped cell formed of a magnetically passive material such as aluminium. Within this holder 9 there is provided a microswitch 11 that is operated by engagement with a switch-operating member 5 that extends downwardly from between the arms of the movable upper yoke 3. The switch-operating member 5 operates microswitch 11 in a manner to be described further below.

On the opposite side of the movable upper yoke 3 from the switch-operating member 3, there is provided a contact bearing bar 14 provided at opposite ends with electrical contacts 12*a*,13*a* that face complementary contacts 12*b*,13*b* that are part of an electrical circuit the operation of which is to be controlled by the relay.

The basic operational principles of the relay according to the embodiment of the invention will now be described.

FIG. 1 shows the relay in the OFF (ie open) condition with electrical contacts 12*a*,12*b* and 13*a*,13*b* open. In this condition, although there is an attractive force between the yokes 3,7 owing to the permanent magnets 1,2 provided on yoke 3, the permanent magnets are chosen such that that attractive force is insufficient to overcome the force of spring 4 that acts to keep the yokes apart. To switch the relay into an ON (ie closed) condition a current is applied to the coil 6 so as to, generate an electromagnetic attraction between the yokes 3,7. This electromagnetic attraction, together with the attractive force generated by the permanent magnets 1,2 is sufficient to overcome the spring 4 and the yokes 3,7 move into contact allowing contacts 12*a*, 12*b* and 13*a*, 13*b* to close.

When the yokes 3,7 are brought together the switching operating member 5 contacts the microswitch 11 which then turns off the supply of current to the coil 6. In this position because the yokes 3,7 are in contact the magnetic force of attraction generated by permanent magnets 1,2 is sufficient to overcome the spring 4 and so although the electromagnetic force of attraction has been removed by turning off the current to coil 6, in this condition the permanent magnets are sufficient to overcome the spring 4 on their own and thus the relay can remain in its ON condition even though no current is supplied to the coil 6. In comparison with a conventional relay that requires constant application of current, this embodiment of the present invention therefore has significantly lower power consumption. If for some reason the yokes 3,7 are moved apart, for example as a consequence of an accidental mechanical blow, such that there is a danger that the spring 4 might overcome the attractive force from the permanent magnets 1,2, then at the same time the switch operating member 5 will be moved away from the microswitch 11 and current is reapplied to the coil 6 so that the yokes 3,7 are brought into contact again. Thus the relay is protected against accidental opening of the contacts.

When it is desired to move the relay from its ON to OFF position again so that the contacts 12*a*,12*b* and 13*a*,13*b* are moved out of contact with each other, current may be supplied to coil 6 in the opposite direction so as to generate a repulsive electromagnetic force. This repulsive force together with the spring force from bias spring 4 will overcome the attractive permanent magnetic force and move the yokes 3,7 apart.

Figure 2:
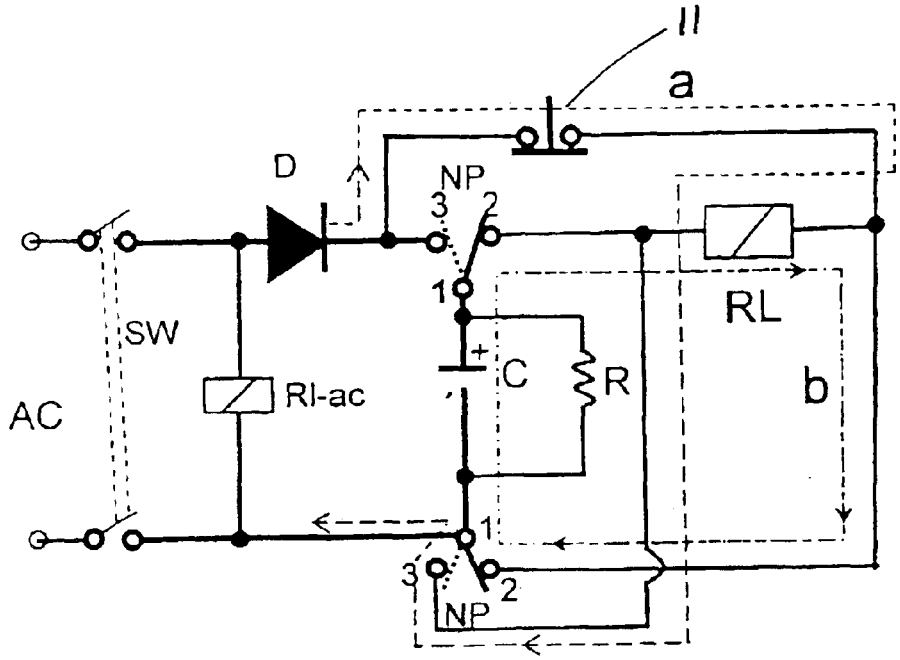
FIG. 2 is a circuit diagram of a relay according to an embodiment of the present invention using an AC power source.

The relay can be used with both an AC and a DC power supply. FIG. 2 shows the operation of the control circuit in the event of AC operation, and FIG. 3 in the event of DC operation.

In the circuit of FIG. 2 an AC power supply is connected to the control circuit through a switch SW and a diode D that converts the AC supply to DC. When switch SW is ON the micro-relay Rl-ac is energized so that its connectors NP1 and NP2 move into the positions where connections 1–3 are made (shown by dotted lines in FIG. 2). This position allows capacitor C to be charged and a DC current flows through the circuit in the direction a indicated by the broken line in FIG. 2 and in particular flows through the coil 6 of the relay indicated by RL in FIG. 2. When the movable upper yoke 3 moves down into contact with the stationary lower yoke 7 and microswitch 11 is operated, microswitch 11 shown in FIG. 2 is opened to interrupt the current flow.

In the event of an accidental opening of the relay, for example as a consequence of a mechanical blow to the relay, when the yokes move apart the microswitch 11 will once more close allowing the current to flow in the circuit as shown by the arrow in the direction a and this will generate an attractive electromagnetic force to bring the yokes 3,7 back into the ON position.

When the switch SW is turned off, the microrelay Rl-ac is turned off the the connectors NP turn to the position making the connections 1–2 shown in FIG. 2. In this position the capacitor C discharges through the coil 6 of the relay RL with the direction of current shown by the broken line b which is in the opposite direction to a. This causes a repulsive electromagnetic force to be generated that moves the yokes apart as discussed above.

Figure 3:
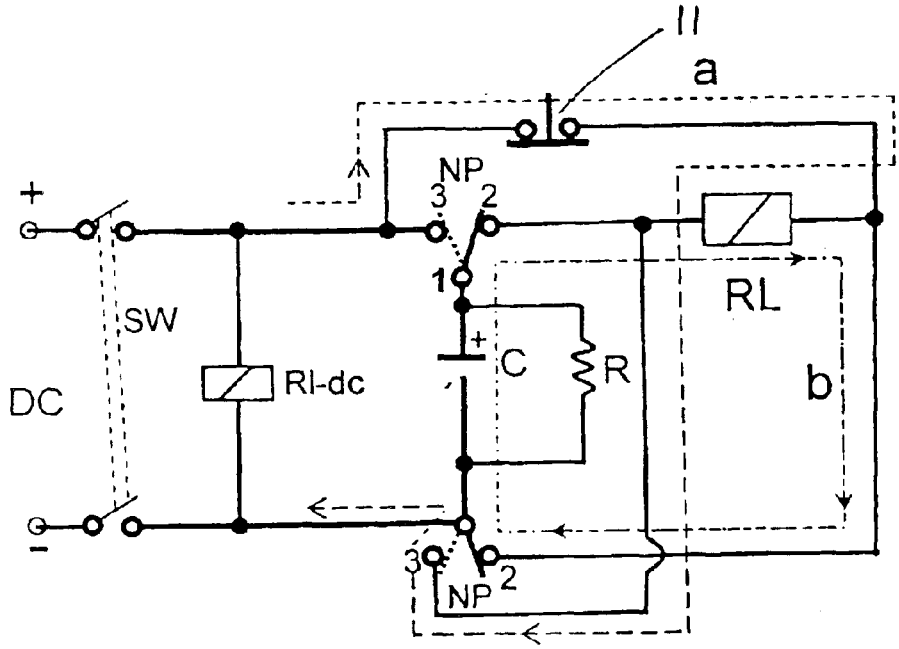
FIG. 3 is a circuit diagram of a relay according to an embodiment of the present invention using a DC power source.

FIG. 3 shows the equivalent circuit when a DC supply is used, the only difference being that the rectifying diode D is not required.

It will thus be seen that at least in its preferred forms the present invention provides a bistable electromagnetic replay having a number of advantages over the same prior art. In particular once the relay is CLOSED it is not necessary to continue to supply current to the coil, though if the relay is accidentally opened current will be supplied again to ensure that the relay remains CLOSED. When it is desired to OPEN the relay, the direction of current in the coil can be simply reversed.

What is claimed is:

1. An electromagnetic relay comprising, a stationary first member and a second member adapted to move towards and away from the first member such that when the second member moves towards the first member an electrical contact is closed, spring means for normally biasing said members apart, permanent magnet means provided on said movable second member for generating a force of attraction between said members, and selectively operable means for generating an electromagnetic force, wherein the permanent magnet means has a strength such that when the first and second members are apart the permanent magnet means is insufficient to overcome the spring means and wherein when the said members are brought together the permanent magnet means is able to hold the members together against the spring means, and wherein said means for generating an electromagnetic force can be operated in a first condition to provide an attractive force between said members sufficient with said permanent magnet means to overcome said spring means and to bring said members together, and in a second condition to provide a repulsive force between members sufficient with said spring means to overcome said permanent magnet means and move said members apart.

2. A relay as claimed in claim 1 wherein switch means are provided whereby said means for generating an electromagnetic force is switched off when said members are brought together.

3. A relay as claimed in claim 2 wherein said switch means is adapted to turn on said means for generating an electromagnetic force in the event of an accidental displacement of said first and second members.

4. A relay as claimed in claim 1 wherein said means for generating an electromagnetic force is provided on said fixed first member.

5. A relay as claimed in claim 1 wherein said first and second members comprise a pair of U-shaped magnetic yokes, the arms of said yokes facing each other.

6. A relay as claimed in claim 5, wherein the permanent magnet means are provided at the ends of the arms of one said yoke.

7. A relay as claimed in claim 5 wherein the means for generating an electromagnetic force comprises a coil wound around one said yoke and means for supplying current to said coil.

8. A relay as claimed in claim 7 wherein means are provided for selectively supplying current in opposite directions to said coil to generate said attractive and repulsive forces.

9. A relay as claimed in claim 8 including an electronic control circuit for supplying said current to said coil.

10. A relay as claimed in claim 9 wherein said control circuit includes switch means for turning said relay on and off, wherein when said relay is turned on said circuit provides a current to said coil in a first direction to generate said attractive electromagnetic force and at the same time a capacitor is charged, and wherein when said relay is turned off said capacitor discharges to supply a current to said coil in the opposite direction to generate said repulsive electromagnetic force.

11. A relay as claimed in claim 10 wherein when said first and second members are brought together a microswitch is operated to open said circuit supplying current to said coil.

12. A relay as claimed in claim 9 wherein said control circuit is adapted to receive an AC power supply and includes rectifying means.

* * * * *